US005396708A

United States Patent [19]

Whitley

[11] Patent Number: 5,396,708

[45] Date of Patent: Mar. 14, 1995

[54] GUN BORE ARBOR

[76] Inventor: Mark J. Whitley, 29 Bryn Mawr Ave., Stratford, N.J. 08084

[21] Appl. No.: 146,986

[22] Filed: Nov. 1, 1993

[51] Int. Cl.[6] ..... F41G 3/00; B23B 5/22

[52] U.S. Cl. ..... 33/234; 33/286; 279/2.02; 279/2.12

[58] Field of Search ..... 33/234, 286, 299, 520, 33/533, 543, 644, 645; 279/2.02, 2.04, 2.09, 2.12

[56] References Cited

U.S. PATENT DOCUMENTS

| | | | |
|---|---|---|---|
| 2,476,981 | 7/1949 | Horton | 33/234 |
| 2,766,532 | 10/1956 | Eisele | 279/2.12 |
| 2,773,309 | 12/1956 | Elliott | 33/234 |
| 3,112,567 | 12/1963 | Flanagan | 33/74 |
| 3,228,108 | 1/1966 | Chaperon | 33/46 |
| 3,744,133 | 7/1973 | Fukushima et al. | 33/234 |
| 3,753,570 | 8/1973 | Espasa | 279/2.09 |
| 3,980,250 | 9/1976 | Persson | 279/2.09 |
| 4,057,905 | 11/1977 | Piaja | 33/234 |
| 4,090,305 | 5/1978 | Cassidy | 33/234 |
| 4,530,162 | 7/1985 | Forrest et al. | 33/228 |
| 4,534,116 | 8/1985 | Davis | 33/234 |
| 4,773,164 | 9/1988 | Taylor et al. | 33/520 |
| 4,861,257 | 8/1989 | Siotani | 279/2.02 |

FOREIGN PATENT DOCUMENTS

| | | | |
|---|---|---|---|
| 339321 | 11/1989 | European Pat. Off. | 279/2.12 |

OTHER PUBLICATIONS

Brownells, Catalog #45, 1992–1993 Catalog, p. 192.

*Primary Examiner*—William A. Cuchlinski, Jr.
*Assistant Examiner*—G. Bradley Bennett
*Attorney, Agent, or Firm*—Volpe and Koenig

[57] ABSTRACT

A self-centering bore arbor device is disclosed which is self-aligning when inserted into the barrel of a shotgun and to which can be mounted a bore scope in a parallax relation with the central axis of the gun barrel. The self-centering property of this device is produced by a single source of pressure transmitted by a helical spring, inside a cylindrical bore collet tube, pressing against a circular 60 degree conical wedge inside the collet tube. This conical wedge distributes this pressure equally outward to the posterior free ends of three spring leaves displaced from each other about the posterior outer circumference of the collet tube by 120 degrees. Under this pressure the free ends of these spring leaves press outward against the inner wall of the gun barrel holding the collet tube in a proper concentric alignment with the gun barrel when the tapered muzzle plug forming the front end of the bore arbor is seated firmly against the inside of the gun barrel muzzle. The adaptable self-centering feature of the bore arbor provides the facility for use with the tapering barrel bore of a shotgun.

6 Claims, 3 Drawing Sheets

FIG. 2
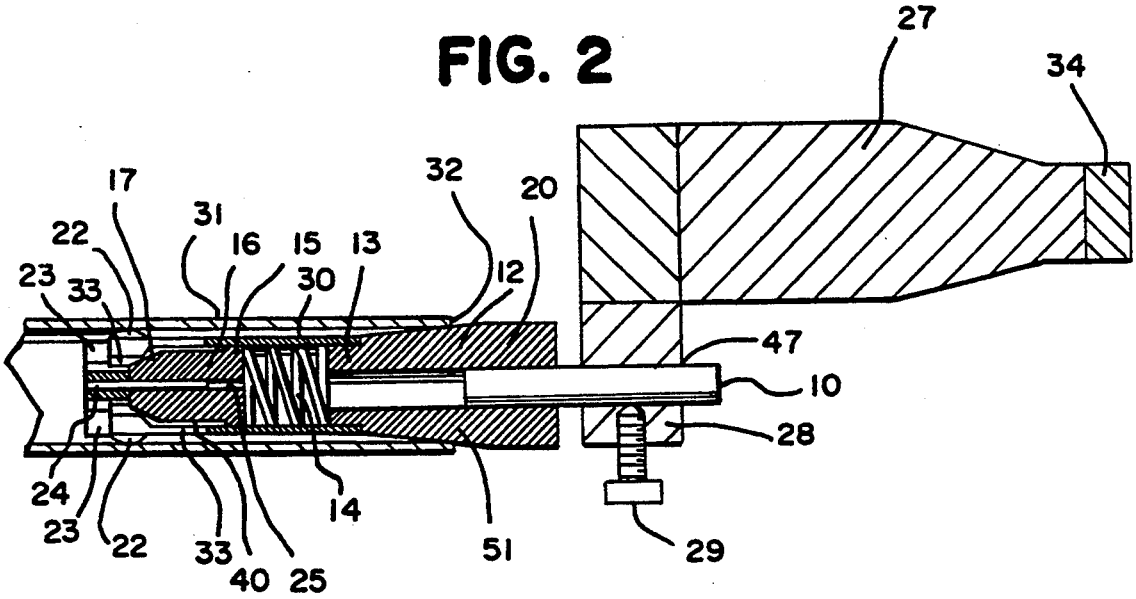
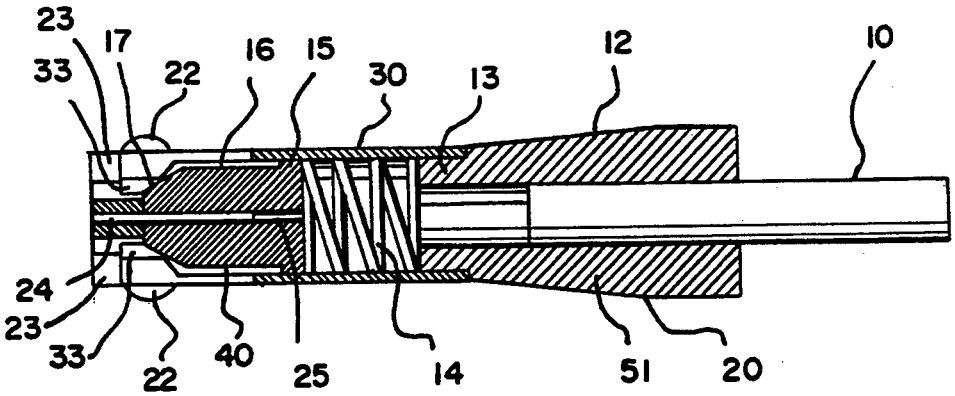
FIG. 5

GUN BORE ARBOR

BACKGROUND OF THE INVENTION

This invention is concerned with a self-centering bore arbor device to be used for mounting and aligning targeting scopes on shotguns.

Among those in the firearms community, it is becoming increasingly common to mount targeting scopes on shotguns and rifles. After being mounted on a gun, the crosshairs of the scope must be aligned with the ammunition trajectory. This is usually accomplished in one of two ways: Shooting ammunition at a target and then trying to estimate in which direction to adjust the crosshairs or the scope to bring the parallax of the scope in line with the ammunition trajectory. This method is time consuming and costly due to the amount of ammunition that must be expended. A second method is to use a bore scope, which is mounted on a bore arbor pin extending from a bore arbor device inserted into the bore of the gun, to prealign the parallax of the targeting scope with the intended trajectory of the ammunition. This is a much simpler and more economical approach.

Bore scopes have been used primarily on rifles, because a rifle bore cross section is circular of essentially constant diameter, and therefore, a simple cylindrical pin or shaft, which fits firmly into the bore of the rifle, can be used to mount the bore scope. However, until recently, bore scopes were not used on shotguns because shotguns have a tapering muzzle or choke which presented an obstacle to the firm seating of the bore arbor and the accurate alignment of bore arbor scope. Several devices have now been proposed to mount bore scopes on shotguns with varying degrees of success, and they are usually complex and costly.

SUMMARY OF THE INVENTION

This invention discloses a simple, inexpensive, self-centering bore arbor which fits firmly into the tapered barrel bore of a shotgun and to which a bore scope can be attached and rapidly aligned, saving both time and ammunition expense and providing for a safer shooting activity. With only minor modifications the device would also work on guns such as rifles having barrel bores of constant diameter.

The self-centering property of this device is produced by a single source of pressure transmitted by a helical spring in a cylindrical collet tube pressing evenly against a circular 6° (six degree) combined taper wedge or cone inside the collet tube. This wedge or cone forces three spring leaves, displaced from each other by 120 degrees around the circumference of the collet tube, radially outward from the collet tube and against the inside of the barrel of the gun, thus holding the collet firmly in a proper concentric alignment with the barrel. The mobility of the spring leaves allows them to automatically adjust the outward circumference of the collet to fit a continuous range of tapered barrel bore sizes and shapes within given dimensional limits. A second feature of the device, that aids in producing a proper alignment, is a precision combined six degree tapered conical muzzle plug at the anterior or front end of the collet tube. This tapering of the plug allows it to seat itself firmly against the inside of the gun muzzle when the bore arbor is inserted into the gun barrel thus providing a second alignment node. Extending outward from the anterior or outer end of the plug, aligned with the longitudinal axis of the barrel and arbor, is a narrow cylindrical pin or shaft to which the bore scope is to be mounted.

Thus a principal object of this invention is to provide a self-centering bore arbor to be used to precision mount a bore scope on a shotgun.

Another object of this invention is to provide a bore arbor which is economical to manufacture and easy to use.

A further object of this invention is to provide a unitary bore arbor which will fit a continuous size range of tapered shotgun barrels or muzzles within given dimensional limits.

A further object of this invention is to provide a device which allows for the inexpensive, rapid, and safe alignment of a bore scope on a shotgun.

These and other objects will be apparent to those skilled in the art.

BRIEF DESCRIPTION OF THE DRAWINGS

A preferred embodiment of the invention is described by way of example with reference to the accompanying drawings in which:

FIG. 2 is a cutaway sideview of a shotgun muzzle with a cutaway sideview of a bore arbor inserted into the muzzle, and with a bore scope mounted on the arbor pin or shaft.

FIG. 5 is a cutaway sideview of an assembled bore arbor.

MORE DETAILED DESCRIPTION OF THE DRAWINGS

Figure 1:
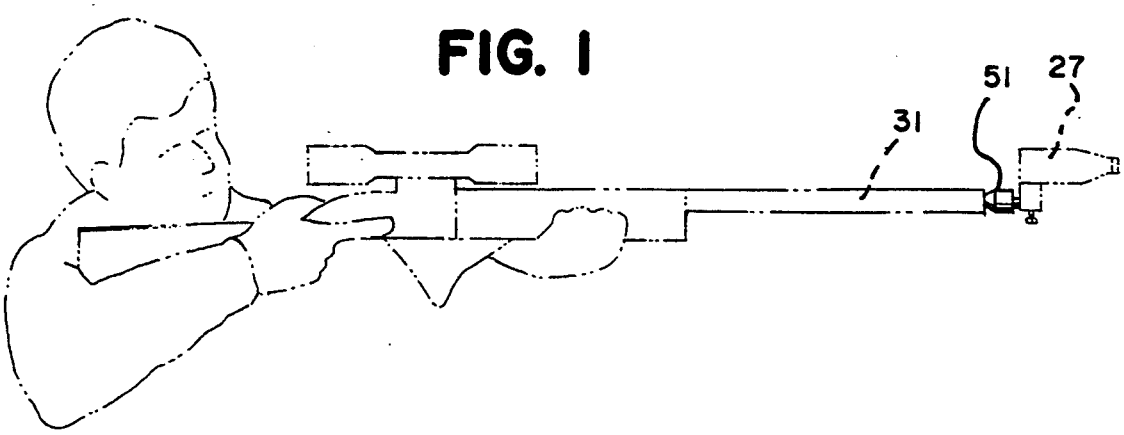
FIG. 1 illustrates a shotgun shooter aiming a shotgun with a bore arbor inserted in its muzzle and a bore scope mounted thereon.

In FIG. 1 a perspective view is presented of a shotgun shooter aligning the bore scope 27 of his shotgun. The bore scope 27 is mounted on the bore arbor 51 which is inserted into the barrel 31 of the shotgun.

In FIG. 2 a cutaway sideview of a preferred embodiment of the bore arbor 51 is presented. Here the bore arbor 51 is firmly inserted into the shotgun barrel 31 with the outer alignment bosses 22 of the main collet leaves pressed against the inside of the shotgun barrel 31 and with the primary muzzle taper 12 of the muzzle plug 20 of the arbor 51 wedged firmly against the inside of the shotgun muzzle 32. Mounted on the primary mounting pin 10 of the bore arbor 51 is bore scope 27. The primary mounting pin 10 is inserted in a mount channel 47 on the bore scope mount 28 and is held in place on the primary mounting pin 10 by a bore scope mount screw 29. The bore scope mount optics are located at the front end of the bore scope at 34.

Figure 7:
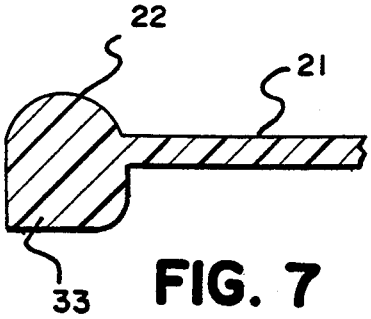
FIG. 7 is an isolated view of the end portion of a leaf of the bore arbor.
Figure 8:
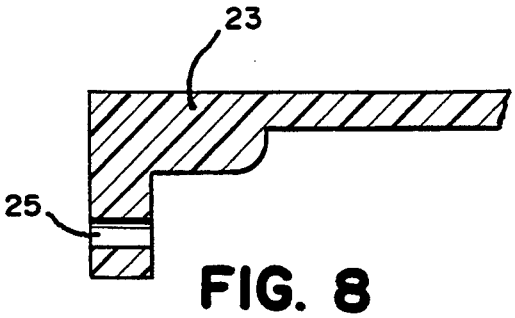
FIG. 8 is an isolated view of the rigid end portion of the bore arbor.
Figure 6:
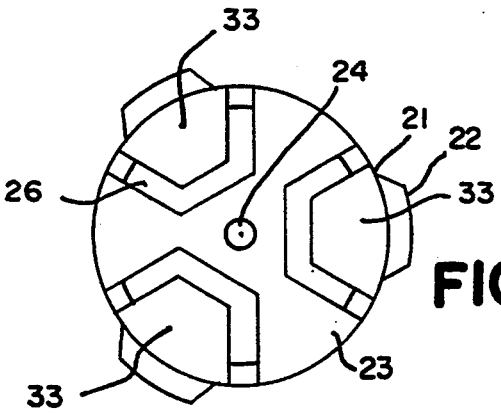
FIG. 6 is a posterior endview of a bore arbor.
Figure 3:
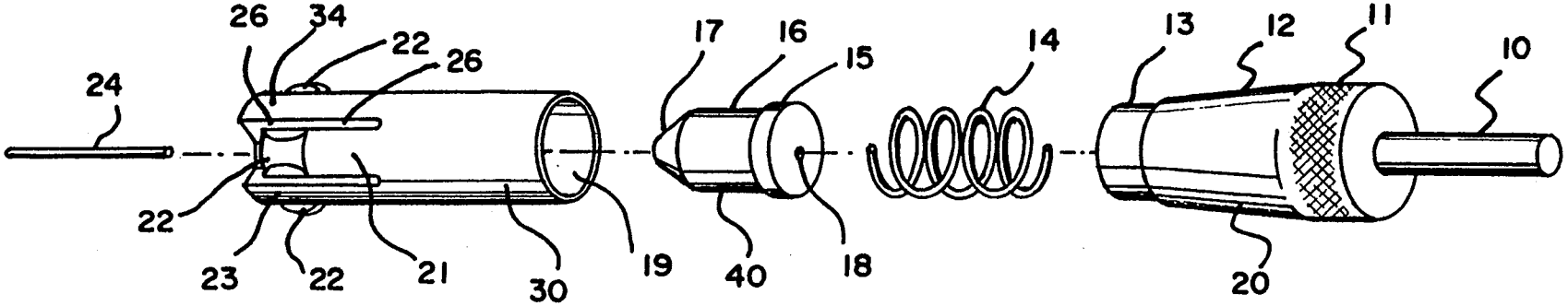
FIG. 3 is an exploded perspective view of one embodiment of the bore arbor illustrating the assembly sequence of its component elements and their relation to each other.

FIGS. 3, 4, 5 and 6 present different views of a preferred embodiment of the bore arbor 51. In FIG. 3, the component elements of the bore arbor are illustrated in an exploded perspective sideview showing their assembly sequence. In practice it is expected that the bore arbor will be provided as a single, fully assembled, sealed unit. Here the cylindrical primary mounting pin 10 is shown extending about an inch outward from the front end of the muzzle plug 20 in concentric alignment with the longitudinal axis of the barrel. The front or anterior lateral portion of the muzzle plug 20 is a cylindrical knurled arbor grip 11 which is approximately one-third inch long and is provided so that it can be gripped by the user to facilitate pulling the bore arbor out of the gun barrel after use. The knurled arbor grip 11 meets a combined 6 degree muzzle taper surface 12 forming a truncated cone approximately one inch long, which produces a firm seat against the inside of the shotgun muzzle 32 when inserted into the gun barrel as shown in FIG. 2. Extending outward from the opposite end of the primary muzzle taper 12, is the short, cylindrical spring compression journal plug 13 which forms an immoveable seat against which the helical primary spring 14 rests. The diameter of the journal plug 13 allows it to fit snugly inside the main collet bore 19 of the cylindrical main collet body 30. The uncompressed length of the primary spring 14 is approximately three-quarters of an inch, the front end of the primary spring 14 rests against the spring compression journal plug 13 and the inner or posterior end of the primary spring 14 rests against the spring pressure base 15 of the collet piston 40. The diameter of the primary spring 14, is approximately the same as that of the spring pressure base 15, which is approximately equal to that of the inner diameter of the main collet tube 19 within which it slides. The spring pressure base 15, forms a short cylindrical pedestal about one-quarter of an inch long. Extending inward from the spring pressure base 15 and concentric with it is the narrower clearance cylinder 16 of the collet piston 40. The clearance cylinder 16 is approximately one-half inch long and meets a sixty degree, approximately one-half inch long conical wedge 17 at its base. The apex of this conical collet wedge forms the inner or posterior end of the collet piston 40. Along the central axis of the collet piston is the narrow alignment pin channel 25, illustrated in FIG. 5 with the alignment pin aperture 18 in the center of the spring pressure base 15. The collet wedge alignment pin 24 is immovably fixed into the posterior end of the main collet body 30 and extends inward about one inch into the main collet tube 19 along its central axis as indicated in FIG. 5. This collet wedge alignment pin 24 serves as a centering guide for the collet piston 40 which glides back and forth along this pin 24. The main collet body 30 has a diameter which is determined by the diameters or gauge caliber of the muzzles or bores of the guns it is intended to fit. It will usually be the case that a particular gun arbor will fit a continuous range of shotgun or rifle barrels within certain diametrical dimensional limits. The main collet body 30 is a cylinder open at one end to allow the insertion of the component elements, already described, into the main collet valve 19. The main collet body 30 is approximately 1.75 to 2.00 inches long. Portions of the lateral sides at the posterior closed end of the main collet valve 19 constitute three independent spring leaves 21 displaced about the circumference of the collet tube along 120 degree outward radii from the central axis of the main collet body 30 and which are approximately one-half inch long, see FIG. 6. Referring now to FIGS. 6, 7, and 8, there it is shown, alternating with these spring leaves 21, the main seat supports 23 which form a rigid end of the main collet body 30 and also are displaced from one another along 120 degree outward directed radii from the central axis. Between the spring leaves 21 and the main seat supports 23 are slits forming clearances 26 for the bases of the alignment bosses 22 which protrude radially outward from the posterior ends of the spring leaves 21. The spring leaves 21 are able to move inward at their free end bases 33 between these clearances 26 when forced under pressure from the gun barrel pressing against the outward protruding alignment bosses 22. Refer to FIGS. 7 and 8 for detailed sideviews of an outer alignment boss 22 on the spring leaf 21 and a main seat support 23, including the pin channel 25, respectively.

Referring again to FIG. 2, there it is shown that the bore arbor 51 is inserted into the gun barrel 31 until the primary muzzle taper 12 of the muzzle plug 20 is planted firmly against the inside of the muzzle 32. The pressure of the gun barrel 31 against the outer alignment bosses 22 forces inward the symmetrically displaced spring leaves 21 which, in turn, press against the collet wedge 17 on the slidable collet piston 40. The collet piston 40 slides along the collet wedge alignment pin 24, inside the main collet tube 19, see FIG. 3, and presses against the primary spring 14 which compresses until an equilibrium pressure is reached. It is this mutual pressure which produces the rigid self-centering alignment of the bore arbor 51 inside the gun barrel 31 when paired with the node formed by the muzzle taper 12 of the muzzle plug 20 against the inside of the gun muzzle 32. The tapered bore of a shotgun will thus not prevent the stable aligning of the bore arbor 51. This operating alignment is illustrated in FIG. 2 with the bore scope mounted on the primary mounting pin 10.

Figure 4:
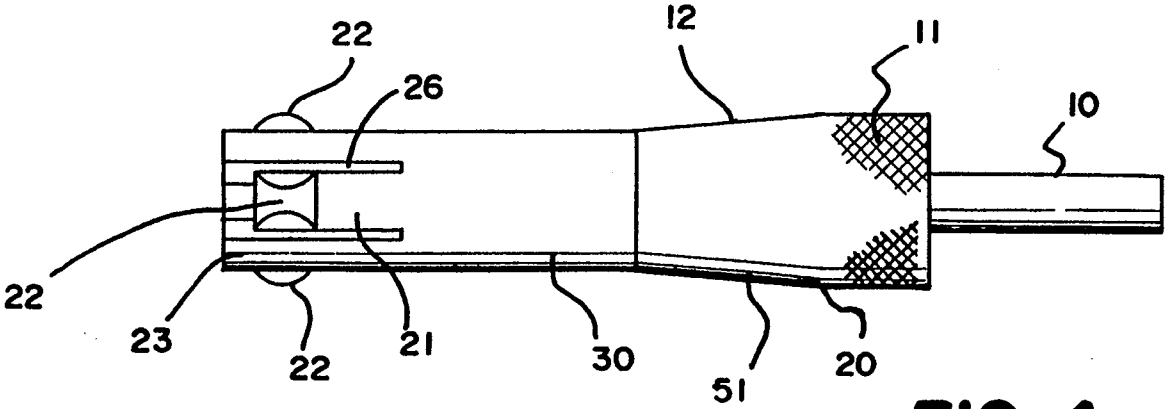
FIG. 4 is a sideview of an assembled bore arbor.

FIG. 5 presents a cutaway sideview of the assembled embodiment of the bore arbor 51 with its components in their operating positions. FIG. 4 presents an outer sideview of the bore arbor 51. Here indicated in assembled form is the primary mounting pin 10, arbor grip 11 on the muzzle plug 20 formed into the muzzle taper 12, meeting the main collet body shaft 30 which at its posterior end forms alternatingly into three spring leaves 21 and three main seat supports 23. The spring leaves 21 having at their posterior ends the alignment bosses 22. In ordinary use, the device would be sealed after assembly.

It is expected that except for the metal primary mounting pin 10, the primary spring 14, and the collet wedge alignment pin 24, the other components of the bore arbor would be injection molded from a durable, non-deformable, polymer plastic, although other materials may also be suitable for fabricating the device.

With appropriate modifications, another embodiment could substitute three partially protruding ball bearings for the spring leaves 21.

It will be understood that the above description of the present invention is susceptible to various modifications, changes and adaptations, and the same are to be comprehended within the meaning and range of the appended claims.

What I claim is:

1. A self-centering bore arbor for partial insertion into the muzzle end of a shotgun barrel in a stable precision alignment with the central longitudinal axis of said barrel, said bore arbor comprising a main body which is an approximately cylindrical collet tube of diameter slightly less than said barrel diameter, the anterior end of said collet tube having means for mounting thereon a bore scope at the muzzle end of said barrel in a parallax relation with the central longitudinal axis of said barrel;

said collet tube further comprising means for firmly seating said bore arbor against said muzzle of said barrel when said bore arbor is inserted sufficiently far into said barrel; portions of the lateral side of said collet tube forming a plurality of alternating parallel strips of rigid columns and posterior outward protruding spring leaf means, the posterior free ends of said spring leaf means providing contact means with the internal wall of said barrel and holding said bore arbor in a stable, self-centering contact relation against the interior cylindrical wall of said barrel when inserted into said barrel; and said collet tube further containing self actuating means for equally distributing pressure radially outward against said spring leaf means to stabilize said bore arbor in said self-centering contact relation with said interior wall of said barrel.

2. The self-centering bore arbor as described in claim 1, wherein said means for firmly seating said bore arbor against said muzzle end of said barrel, comprises a truncated conically tapered plug with a variable diameter whose posterior end, which is inserted into the said barrel, is of a diameter slightly less than that of said barrel and at its furthest anterior end has diameter slightly exceeding that of said barrel muzzle allowing said bore arbor to be seated firmly against said barrel muzzle when said bore arbor is inserted sufficiently far into said barrel.

3. The self-centering bore arbor as described in claim 2, wherein said means for mounting said bore scope comprises a narrow cylindrical shaft attached in firm axial alignment with the central longitudinal axis of said conically tapered bore arbor plug, and extending anteriorly outward from said plug and of sufficient length to accommodate the attachment of a bore scope.

4. The self-centering bore arbor as described in claim 2, wherein the spring leaf means comprises three independent spring leaves formed from a portion of the posterior lateral side of said collet tube, their posterior free ends displaced from each other around the circumference of said collet tube along 120 degree lines radiating outward from the central longitudinal axis of said collet tube, said free ends of said spring leaves forming approximately hemispherical outward protruding bosses, the circular envelope tangent to said bosses being of slightly larger diameter than that of said barrel into which they will be inserted; alternating about said circumference with said spring leaves and displaced from each other along 120 degree lines radiating outward from said central axis of said collet tube are three rigid columns forming the fixed posterior lateral sides of said cylindrical collet tube and the closed posterior base of said collet tube, and the spaces between said rigid columns forming depressions opening into the hollow interior of said collet tube, said depressions forming recesses into which said free ends of said spring leaves can move inward as the interior wall of said gun barrel presses against said leaf bosses; inside said collet tube and seated against the posterior base of said plug is a helical centering spring, the opposite posterior end of said centering spring pressing against the anterior base end of a sliding cylindrical piston inside said collet tube, the axis of said piston being aligned with the axis of said tube, said piston having its posterior end formed into 60 degree conical centering wedge, said conical centering wedge having its longitudinal axis aligned with the axis of said collet tube, said conical centering wedge guided along a pin fixed in the posterior base of said collet tube, said pin aligned with said central longitudinal axis of said collet tube, said conical centering wedge pressing outward posteriorly against said spring leaves as said spring leaves are pressed inward into said collet tube interior by said barrel wall, said conical centering wedge also pressing anteriorly forward against said centering spring, said centering spring when compressed determining, at equilibrium, a rigid alignment of said bore arbor inside said barrel in combination with said muzzle plug seated firmly against the inside of said barrel muzzle.

5. The bore arbor of claim 2, wherein said anterior portion of said lateral side of said plug is formed into a knurled arbor grip to facilitate gripping between the fingers of the hand of a user.

6. A self-centering bore arbor for alignment of a sighting instrument in a parallax relation with a central longitudinal axis of a gun barrel, said bore arbor including a body member having an anterior tapered portion which engages the barrel end, retaining means which contact the barrel bore, and means for mounting the sighting instrument to said body member, wherein the improvement is characterized by said body member including:

a collet tube with at least three integrally formed retaining means, each of said retaining means having a first portion, for contacting the bore, and a second portion, which protrudes into said tube;

a piston, slidably disposed in said collet tube, with a tapered portion which engages said second portion of each of said retaining means; and self actuating means for biasing said piston against said second portions such that each of said retaining means is displaced radially outward against the bore to align and secure said body member.

* * * * *